United States Patent [19]

Suga

[11] 4,165,772

[45] Aug. 28, 1979

[54] DEVICE FOR DRIVING SCREWS, RIVETS AND THE LIKE

[76] Inventor: Asakichi Suga, 3-20-7 Chuo, Ohta-ku, Tokyo, Japan

[21] Appl. No.: 879,398

[22] Filed: Feb. 21, 1978

[30] Foreign Application Priority Data

Feb. 18, 1977 [JP] Japan ..... 52-16812

[51] Int. Cl.[2] ..... B25B 15/00

[52] U.S. Cl. ..... 145/52; 145/50 D

[58] Field of Search ..... 145/50 D, 52

[56] References Cited

U.S. PATENT DOCUMENTS

| | | | |
|---|---|---|---|
| 953,434 | 3/1910 | Northam | 145/52 |
| 1,350,558 | 8/1920 | Messenger | 145/52 |
| 1,628,144 | 5/1927 | Herrmann | 145/52 |
| 2,302,691 | 11/1942 | Green | 145/52 |
| 3,901,298 | 8/1975 | Eby | 145/52 |

*Primary Examiner*—Robert Louis Spruill
*Assistant Examiner*—J. T. Zatarga
*Attorney, Agent, or Firm*—Lackenbach, Lilling & Siegel

[57] ABSTRACT

A device for driving screws, rivets and the like is disclosed which has a nozzle consisting of an upper half part and an under half part, which are movable relative to each other. By pressing a lever with a finger of the operator and then releasing it, the nozzle is opened and closed in order to grasp screws, rivets and the like. Between the two halves of the nozzle a center rod extends coaxially with the nozzle; and, by pressing a grip end cylinder of the device, the nozzle is opened and simultaneously the center rod is thrusted towards the tip of the nozzle so that the rivet or the like may be pushed out. Alternatively, by rotating a rotary cylinder of the device while pressing the grip end cylinder, the center rod is thrusted towards the tip of the nozzle and rotated so that the screw may be driven in a work piece.

4 Claims, 7 Drawing Figures

DEVICE FOR DRIVING SCREWS, RIVETS AND THE LIKE

BACKGROUND OF THE INVENTION

The present invention relates to a device for driving screws, rivets and the like for use in fine hand works such as fastening screws or driving pins or rivets into a small hole.

In manufacturing, assembling and disassembling various precision instruments and machines such as watches and clocks, a great number of fine hand works are required. Since there has not yet been known any suitable device for effecting such type of fine work conveniently, the worker had to do the work with a pincette and a screw driver. For example, he must pinch a very small screw with a pincette, align the pinched screw to a corresponding small threaded hole and drive it into the hole with a screw driver. This is time and labor consuming and causes the worker to feel a great deal of fatigue.

SUMMARY OF THE INVENTION

Accordingly, it is the principal object of the present invention to provide a device for driving screws, rivets, pins and the like, which makes the above described fine works very simple and easy.

According to the invention, this object is attained by holding a screw, rivet or the like with a nozzle portion of the device which can be opened and closed at will externally and by driving the screw or rivet, while holding it with the nozzle, by means of a center thrust rod, which may simultaneously rotate if desired.

Other and further objects, features and advantages of the invention will appear more fully from the following description taken in connection with the accompanying drawings.

BRIEF DESCRIPTION OF DRAWINGS

The accompanying drawings illustrate one embodiment of the present invention, in which.

DETAILED DESCRIPTION OF THE INVENTION

Figure 1:
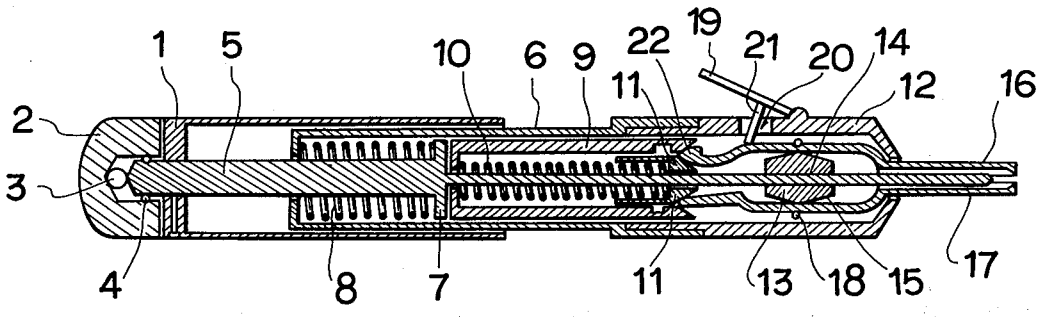
FIGS. 1 through 4 are longitudinal cross sectional views showing one form of the structure and operation of the device of the present invention in its different operational positions where the device is used as a screw driver.
Figure 2:
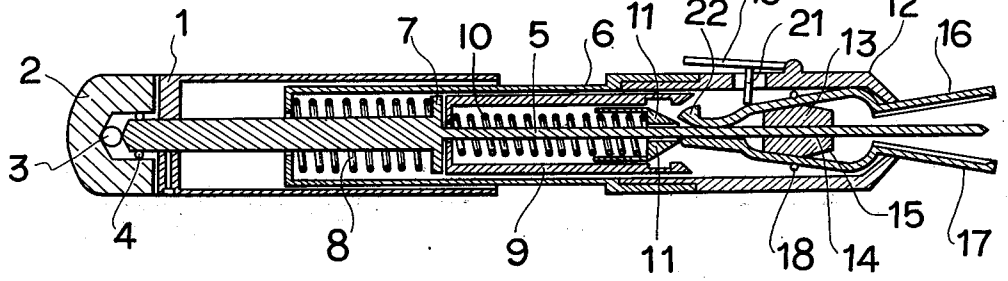
Figure 3:
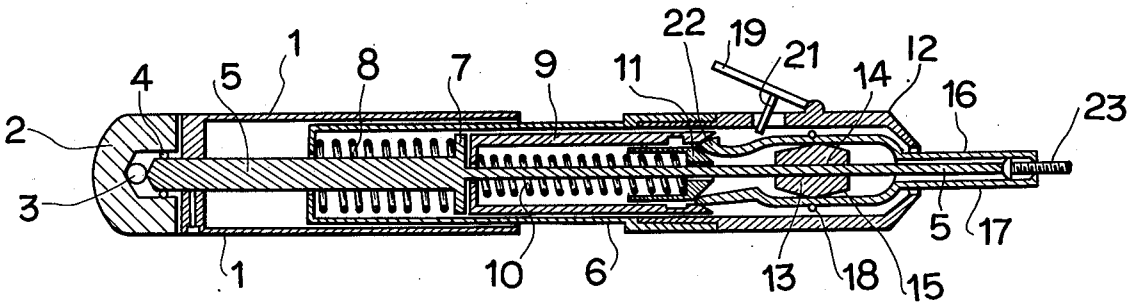
Figure 4:
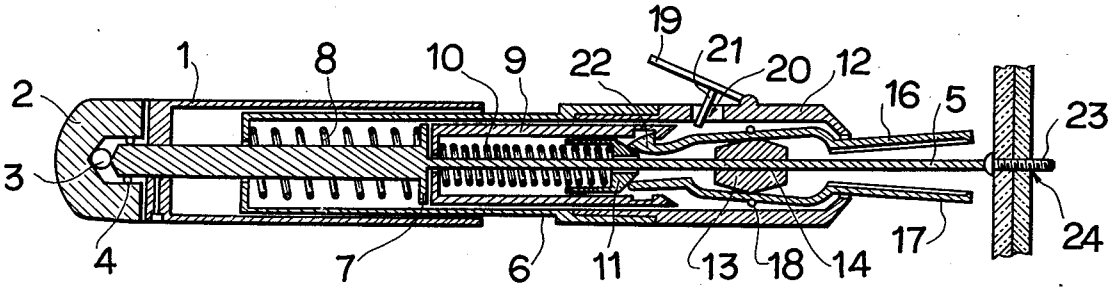

Referring now to the drawings, wherein the device of the present invention is illustrated as it is intended to be used as a screw driver, the invention will be described in detail.

In the drawings of FIGS. 1 through 4 clearly showing the composition and features of the invention, the reference numeral 1 designates a rotary cylinder and the numeral 2 designates a grip end cylinder. The rotary cylinder 1 is closed at its rear or bottom end and open at the fore or top end. The grip end cylinder 2 is rotatably attached to the rotary cylinder 1 by a bearing 3 and a ring 4. From the bottom of the rotary cylinder 1 an elongated center rod 5 extends towards the tip of the device. The center rod 5 is aligned to the center line of the cylinder 1 and is fixed to the cylinder 1 at its bottom end portion by means of a screw bolt. The free end portion of the rod is shaped into the form of a any conventionally used screw driver. As a whole, the contour of the center rod is similar to that of the conventional screw driver. The center rod is exchangeable if necessary. A stationary cylinder 6 is telescopically fitted into the rotary cylinder 1 so that relative sliding and rotational movement is possible between them. Between the bottom wall of the stationary cylinder 6 and a stopper 7 formed on the center rod 5 a spring 8 is positioned. Within the stationary cylinder 6 and on the forward side of the stopper 7, there is a sleeve 9 with its fore end being tapered inwards. In the vicinity of the tapered end, the sleeve 9 has a notch. The sleeve encloses a spring 10, one end of which abuts against the bottom wall of the sleeve 9 and the other end of which engages with a cylindrical pressing block 11 which is retractable into the sleeve 9 along the direction of the center rod against the force of the spring 10. The fore end of the pressing block is tapered outwards as seen from the drawings. To the stationary cylinder 6, a top cylinder 12 is fixedly connected by means of threading. A bush 13 is fitted into the top cylinder 12.

Figure 6:
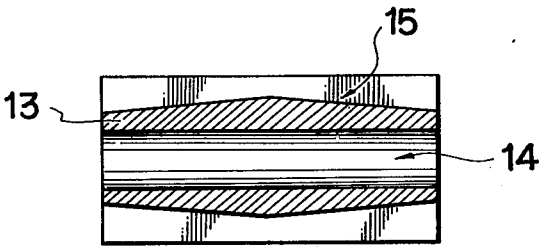
FIG. 6 is a cross-sectional view of the bush taken along line A—A in FIG. 5.
Figure 5:
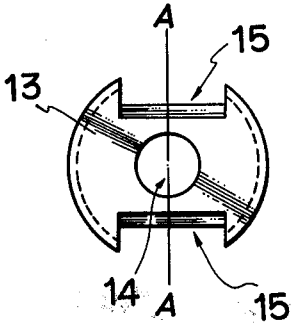
FIG. 5 is a front view of a bush disposed in the device.

As best seen from FIG. 5, the bush is formed with a center bore 14 through which the center rod 5 passes, and upper and under grooves 15. The groove is so shaped that the depth of the groove is smallest at its middle portion and gradually increases toward the both edges as clearly seen from FIG. 6.

A nozzle consisting of a pair of parts, i.e. upper half 16 and under half 17, constitute the tip portion of the device. The upper nozzle half 16 is received in the upper groove 15 of the bush 13 and the under nozzle half 17 is received in the under groove 15. A ring 18 secures the both nozzle halves swing movably. On the top cylinder 12, a swing lever 19 is mounted with a pin 21 depending from the lever against the upper nozzle half 16 and passing through a bore 20 formed in the wall of the top cylinder 12. The tip end portion of each of the upper and under nozzle halves 16 and 17 has a semicircular cross section and the rear end portion of the upper nozzle half 16 is formed as a hook 22.

The operation of the above described device is as follows. When used, the user grips the rotary cylinder 1 and the stationary cylinder 6 with his hand and then pushes down the swing lever 19 with his thumb. Consequently, the pressing block 11 is retracted into the sleeve 9 by the pin 21 against the action of the spring 10 and, simultaneously the upper nozzle half 16 is opened. At this time, the under nozzle half 17 also opens because of the fore part of it is heavier than the rear part (see FIG. 2). Keeping this position of the device, the user approaches the head of a screw 23 to the free end of the center rods and then releases his thumb from the swing lever 19. The spring 10 again urges the pressing block 11 to move forwards and, therefore, the upper and under nozzle halves 16 and 17 close pinching the screw 23. Holding the screw 23 in this manner, the user brings the screw into contact with a matching threaded hole 24 bored in a work piece. Since the screw 23 is firmly pinched by the nozzle 16 and 17, it can not fall out of the device when it is brought to the hole and it can direct its point to any direction, upwards, downwards, leftwards or rightwards (see FIG. 3). After aligning the pinched screw 23 to the matching hole, the user rotates the rotary cylinder 1 while slightly pressing the grip end cylinder 2. Thus, the center rod 5 drives the screw into the hole as to fasten the work piece. As this occurs, the grip end cylinder 2 and the rotary cylinder 1 move toward the front relative to the stationary cylinder 6 fixed to the top cylinder 12 and, therefore, the sleeve 9 is also moved toward the front by the stopper 7. Accordingly, with the increase of movement of the screw driver into the work piece, the opening of the nozzle is gradually increased. Therefore, the work piece is prevented from being damaged by the upper and under nozzle halves 16 and 17.

By pressing the grip end cylinder 2 to some extent, the notch of the sleeve 9 engages with the hook 22 of the upper nozzle half 16, which prevents the sleeve from being retracted. The retraction is achieved by pressing the swing lever 19.

As will be understood from the foregoing, the use of the device of the present invention as a screw driver brings forth remarkable advantages and many practical merits. In repairing and assembling watches, spectacles and the like, it makes screw fastening works with very small screws simple and easy. Furthermore, with the device of the present invention, one need no longer be afraid of the screw being lost.

While the present invention has a particular effect in performing fine works with such small screws as are generally used in clocks, watches and spectacles, the application of the invention is not limited only to this field of application. The invention is also applicable to other hand works using some larger screws and almost the same effect is attainable.

It should be noted that the above described embodiment in which the device of the invention is used as a screw driver was given to illustrate only one typical example of various uses of the invention and that the device functions as a multipurpose tool. For example, by flattening the top end of the center rod 5, the device may be used to push in pins or rivets or to hold them. Further, pinching a nut between the upper and under nozzle halves 16 and 17, man can screw the nut to a mating bolt in the same manner as described above regarding a screw.

Also, it is possible to drive a nail in the ceiling by further elongating the nozzle parts 16 and 17 and the center rod 5.

Figure 7:
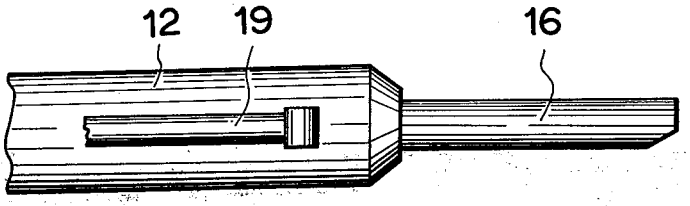
FIG. 7 is a plan view of the tip portion of the device.

As illustrated in FIG. 7, when one corner edge of the top end of each the nozzle halves 16 and 17 is beveled, the device of the invention will more easily pick up screws and the like and, thereby, the device may be more advantageously used.

In this manner, the device of the present invention is applicable for various purposes by suitably exchanging the upper and under nozzle halves 16 and 17 and the center rod 5. The efficiency of working in increased by the invention and there is no possibility of working parts being lost. The device of the invention is very easy to handle and is a very convenient tool for Sunday carpentry.

While the invention has been particularly shown and described with reference to a preferred embodiment thereof, it will be understood by those skilled in the art that the foregoing and other changes in form and details can be made therein without departing from the spirit and scope of the invention.

I claim:

1. A device for driving screws, rivets and the like comprising:

a rotary cylinder to which a grip end cylinder is rotatably attached;

a center rod with one end secured to a bottom portion of the rotary cylinder and having a stopper formed on a middle portion of said center rod;

a stationary cylinder telescopically and coaxially disposed in the rotary cylinder so that relative sliding movement and relative rotational movement between said stationary and said rotary cylinders are possible;

a sleeve coaxially disposed in said stationary cylinder on the fore side of the stopper, encircling the center rod and having a notch formed at a fore end portion of the sleeve;

a cylindrical pressing block slidingly movably mounted around the center rod and positioned within said sleeve;

a spring coaxially disposed around said center rod and extending from the stopper to said pressing block to urge said pressing block toward a tip portion of said device;

a top cylinder connected with said stationary cylinder and having a bore;

a swing lever fixed to an exterior surface of said top cylinder and having a pin depending from said lever and passing through said bore in said top cylinder;

a nozzle consisting of upper and under nozzle portions and having a hook formed on the upper nozzle portion engageable with said notch of the sleeve; and a bush disposed between said nozzle portions and shaped to permit swinging motion of said nozzle portions to open and close the nozzle portions relative to each other, such that, when said lever is depressed, said pin comes in contact with one of the nozzle portions and the nozzle portions move on said bush to an open position, said nozzle portions moving on said bush to a closed position when said hook engages said notch and said pressing block is forced between said nozzle portions.

2. A device for driving screws, rivets and the like as claimed in claim 1, wherein the free end of said center rod is shaped to the form of a screw driver.

3. A device for driving screws, rivets and the like as claimed in claim 1, wherein the free end of said center rod is made as a flat end surface.

4. A device for driving screws, rivets and the like as claimed in any one of claims 1, 2 and 3, wherein one corner edge of the tip portion of each of the upper and under nozzle portions is beveled.

* * * * *